US011235614B2

(12) United States Patent
Tefenlili

(10) Patent No.: US 11,235,614 B2
(45) Date of Patent: Feb. 1, 2022

(54) RECEIPT HOLDER DEVICE

(71) Applicant: Noelia Tefenlili, Phoenix, AZ (US)

(72) Inventor: Noelia Tefenlili, Phoenix, AZ (US)

( * ) Notice: Subject to any disclaimer, the term of this patent is extended or adjusted under 35 U.S.C. 154(b) by 222 days.

(21) Appl. No.: 16/377,679

(22) Filed: Apr. 8, 2019

(65) Prior Publication Data

US 2019/0308439 A1 Oct. 10, 2019

Related U.S. Application Data

(60) Provisional application No. 62/654,257, filed on Apr. 6, 2018.

(51) Int. Cl.

| | |
|---|---|
| ***B42F 9/00*** | (2006.01) |
| ***B42F 7/06*** | (2006.01) |
| ***B42D 5/00*** | (2006.01) |
| ***B42F 1/02*** | (2006.01) |
| ***A45C 13/10*** | (2006.01) |
| ***A45C 13/00*** | (2006.01) |
| ***A45C 11/18*** | (2006.01) |
| ***A45C 1/00*** | (2006.01) |

(52) U.S. Cl.

CPC ..... *B42F 9/005* (2013.01); *B42D 5/006* (2013.01); *B42F 7/065* (2013.01); *B42F 1/02* (2013.01); *B42P 2201/00* (2013.01); *B42P 2241/04* (2013.01); *B42P 2241/18* (2013.01); *B42P 2241/20* (2013.01)

(58) Field of Classification Search

CPC .. B42F 9/005; B42F 7/065; B42F 1/02; B42F 9/002; B42F 7/06; B42F 9/00; B42D 5/006; B42D 5/00; B42P 2241/18; B42P 2241/04; B42P 2201/00; B42P 2241/20; B42P 2241/16; B42P 2241/02; A45C 13/1069; A45C 13/008; A45C 11/18; A45C 1/00; A45C 13/10; A45C 13/00

USPC ..... 40/1, 299.01, 647, 658; 281/3.1, 7, 9, 281/12, 14, 15.1, 29, 45, 48, 49; 283/60.1, 60.2, 63.1, 64, 66.1, 66.2; 402/8, 9, 18, 60, 68, 69, 70, 71, 73, 74, 402/75, 76, 77, 79, 500, 502

See application file for complete search history.

(56) References Cited

U.S. PATENT DOCUMENTS

| | | | | |
|---|---|---|---|---|
| 5,294,208 | A | 3/1994 | Tremmel, Jr. | |
| 7,387,461 | B2 | 6/2008 | Brandt | |
| 7,491,162 | B2 | 2/2009 | Penn | |
| 2005/0046172 | A1* | 3/2005 | Pacifico | B42F 7/06 281/15.1 |
| 2006/0055166 | A1 | 3/2006 | Crawford | |

* cited by examiner

*Primary Examiner* — Justin V Lewis

(74) *Attorney, Agent, or Firm* — Runyan Law; Charles Runyan

(57) ABSTRACT

A receipt holder device is disclosed herein including an organizer portfolio including a front-cover, at least one card holder, a storage compartment, a rear-cover, a first-clip, a first-elastic-fastener, a second-clip, and a second-elastic-fastener. The front-cover and the rear-cover of the organizer portfolio are hingedly connected and configured to open and close to access contents within the organizer portfolio. The organizer portfolio includes two or more columns for securing and organizing receipts within. Business cards and other items are also organized and stored within providing a waterproof personal day planner and tax receipt organizer.

18 Claims, 5 Drawing Sheets

RECEIPT HOLDER DEVICE

CROSS REFERENCE TO RELATED APPLICATION

The present application is related to and claims priority to U.S. Provisional Patent Application No. 62/654,257 filed Apr. 6, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of receptacles and more specifically relates to organizers and holders.

2. Description of Related Art

After making a purchase, it can be difficult to find an appropriate place to store the receipt. Without the receipt, individuals will not be able to later refund or exchange the item. In addition, receipts are useful when filing taxes and assessing deductions. Individuals spend an unnecessary amount of time searching for lost receipts due to a lack of organization. A suitable solution is desired.

U.S. Pat. No. 7,491,162 to Emily Penn relates to a daily organizer. The described daily organizer includes an organizer which includes a plurality of holders for holding recording media such as disposable cards. A first holder has a first upper edge and a second holder has a second upper edge and a second lower edge. The second holder is disposed behind the first holder and attached thereto at the second lower edge so that the second upper edge is above the first upper edge. The first holder and second holder are movable with respect to each other about the second lower edge. A method for organizing information includes recording information on a plurality of items of a disposable recording medium in accordance with categories of information, each item corresponding to one category and one subcategory; and arranging those items in the organizer including removing and/or inserting the items.

BRIEF SUMMARY OF THE INVENTION

In view of the foregoing disadvantages inherent in the known receptacle art, the present disclosure provides a novel receipt holder device. The general purpose of the present disclosure, which will be described subsequently in greater detail, is to provide a storage solution for organizing and documenting receipts for tax deductions, and personal daily expenses.

A receipt holder device is disclosed herein. The receipt holder device includes an organizer portfolio including a front-cover, at least one card holder, a storage compartment, a rear-cover, a first-clip, a first-elastic-fastener, a second-clip, and a second-elastic-fastener. The front-cover and the rear-cover of the organizer portfolio are hingedly connected and configured to open and close to access contents within the organizer portfolio. The at least one card holder and the storage compartment are positioned on an interior portion of the front-cover. The at least one card holder is configured to receive and hold a business card or other card within.

In a preferred embodiment, the organizer portfolio includes four or more of the card holders for conveniently storing business cards or other cards. The storage compartment is structured to house at least one office supply item such as paperclips and tabs for further organizing tax receipts and other receipts and documents. The interior portion of the rear-cover is separated into a first-half and a second-half for organizing two columns of receipts. The first half includes the first-clip and the first-elastic-fastener and the second-half comprising the second-clip and the second-elastic-fastener. The first-clip and the second-clip comprise biasing means for securing receipts. The first-elastic-fastener and the second-elastic-fastener are configured to further secure longer receipts in a secure and organized manner.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a receipt holder device, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to receptacles and more particularly to a receipt holder device as used to improve the organization of receipts and other items.

Generally, the present invention provides a waterproof personal day planner and tax receipt organizer. The device comprises a pen holder, card holder, and receipt storage pocket. It includes a second notebook sized day planner with an internal note pad binder, clear retaining pocket, and large tax receipt pocket with a magnetic closure. The device protects, holds, and organizes receipts for everyday purchases and tax deductions. The present invention allows individuals to track their purchases and deductions easily and accurately.

The receipt holder device is designed to hold and store receipts. A large and small (everyday use) version is available. The device is waterproof and holds receipts inside of pockets and/or using elastic. A pen holder is also included. The elastic is designed to secure the paper. A clear plastic page is included to hold paper clips and business cards. The larger version is identical, but with double the space for individuals with business expenses and receipts for tax deductions. The larger version may be as big as a notebook and includes a magnetic closure. An option for adding a calendar may be available.

Figure 1:
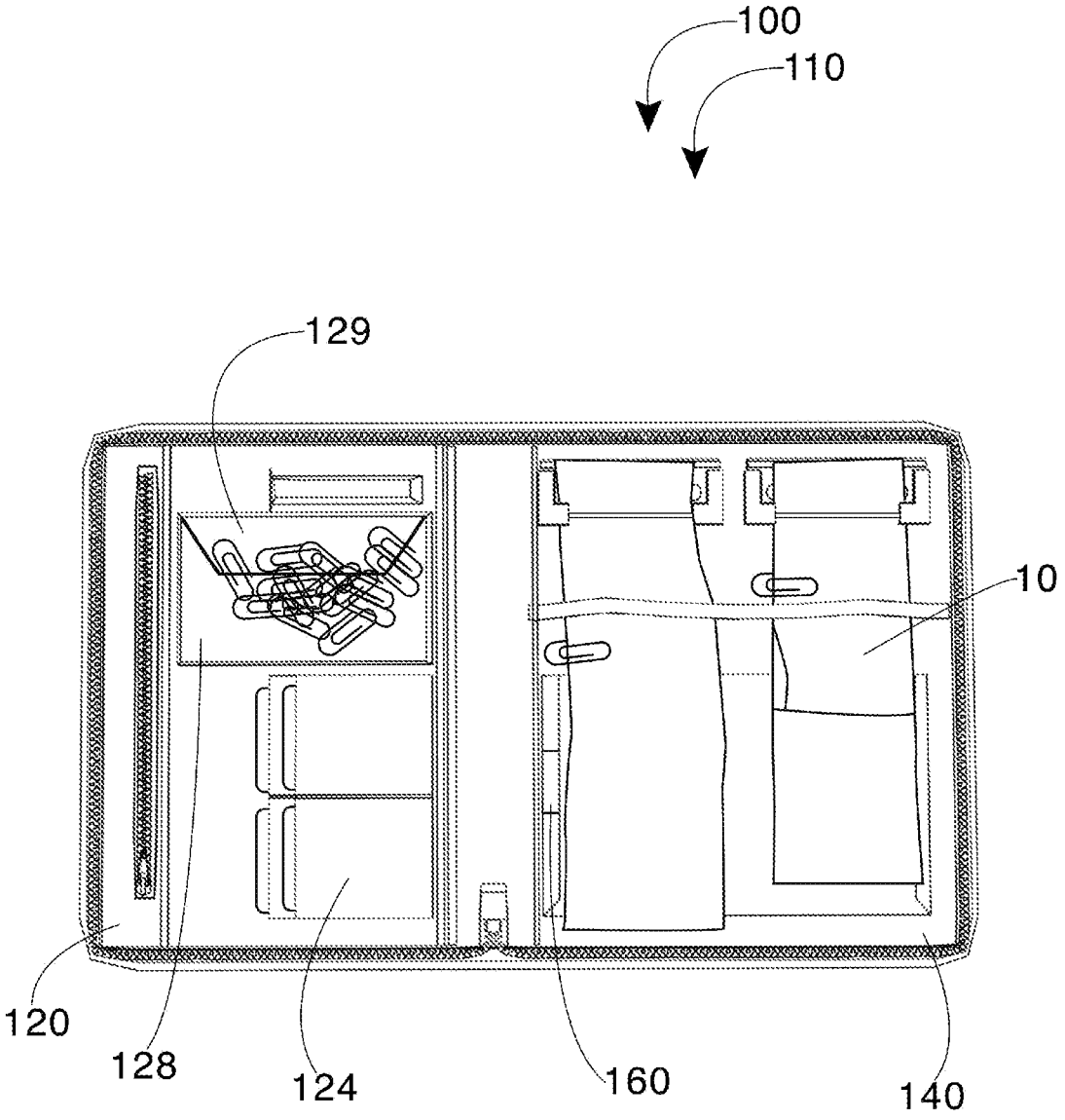
FIG. 1 is a top view of the receipt holder device during an 'in-use' condition, according to an embodiment of the disclosure.

Referring now more specifically to the drawings by numerals of reference, there is shown in FIGS. 1-5, various views of a receipt holder device 100. FIG. 1 shows a receipt holder device 100 according to an embodiment of the present disclosure. As illustrated, the receipt holder device 100 may include a waterproof organizer portfolio 110 having a front-cover 120, at least one card holder 124, a storage compartment 128, a rear-cover 140, a first-clip 142, a first-elastic-fastener 146, a second-clip 152, and a second-elastic-fastener 156. The organizer portfolio 110 is structured to provide organized storage for tax receipts 10 and every day purchases.

Figure 2:
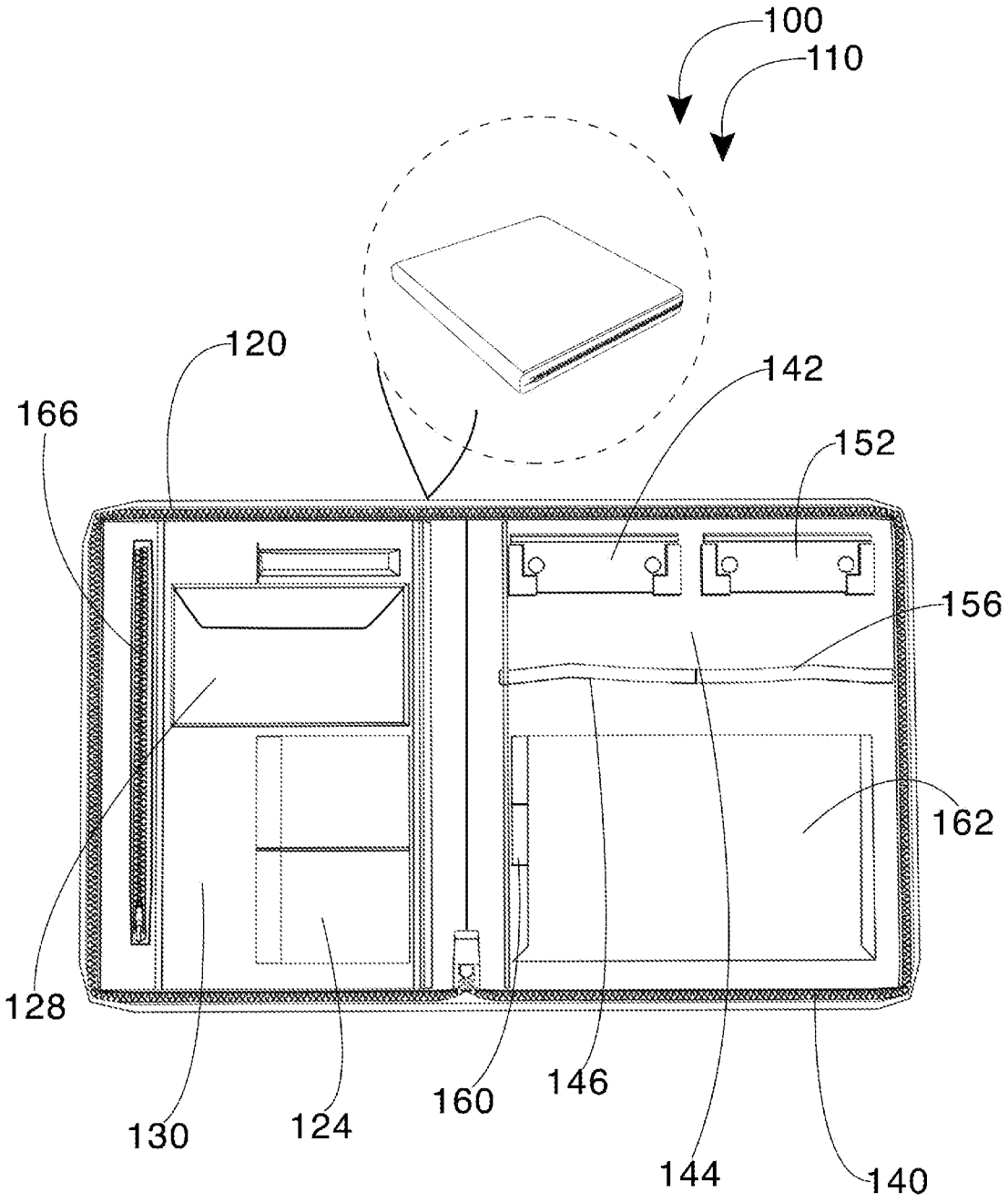
FIG. 2 is a top view of the receipt holder device of FIG. 1, according to an embodiment of the present disclosure.

FIG. 2 shows a perspective view of the receipt holder device 100 of FIG. 1, according to an embodiment of the present disclosure. As above, the receipt holder device 100 may include the organizer portfolio 110 including the front-cover 120, the at least one card holder 124, the storage compartment 128, the rear-cover 140, the first-clip 142, the first-elastic-fastener 146, the second-clip 152, and the second-elastic-fastener 156. The front-cover 120 and the rear-cover 140 of the organizer portfolio 110 are hingedly connected and configured to open and close to access contents within the organizer portfolio 110. The at least one card holder 124 and the storage compartment 128 are positioned on an interior portion 130 of the front-cover 120. The at least one card holder 124 is configured to receive and hold a card within. In a preferred embodiment, the organizer portfolio 110 includes four or more of the card holders 124 for conveniently storing business cards or other cards.

The storage compartment 128 is structured to house at least one office supply item within such as paperclips and tabs for marking. These office supply items may be used to further organize, mark, and secure receipts 10 stored within the organizer portfolio 110. The storage compartment 128 may comprise a transparent, flexible, sheet-like plastic material and include a sealable flap 129 having appropriate fastening means. The receipt holder device 100 may further include a pen holder 160. The pen holder 160 may be positioned on an interior portion 144 of the rear-cover 140 of the organizer portfolio 110.

Figure 3:
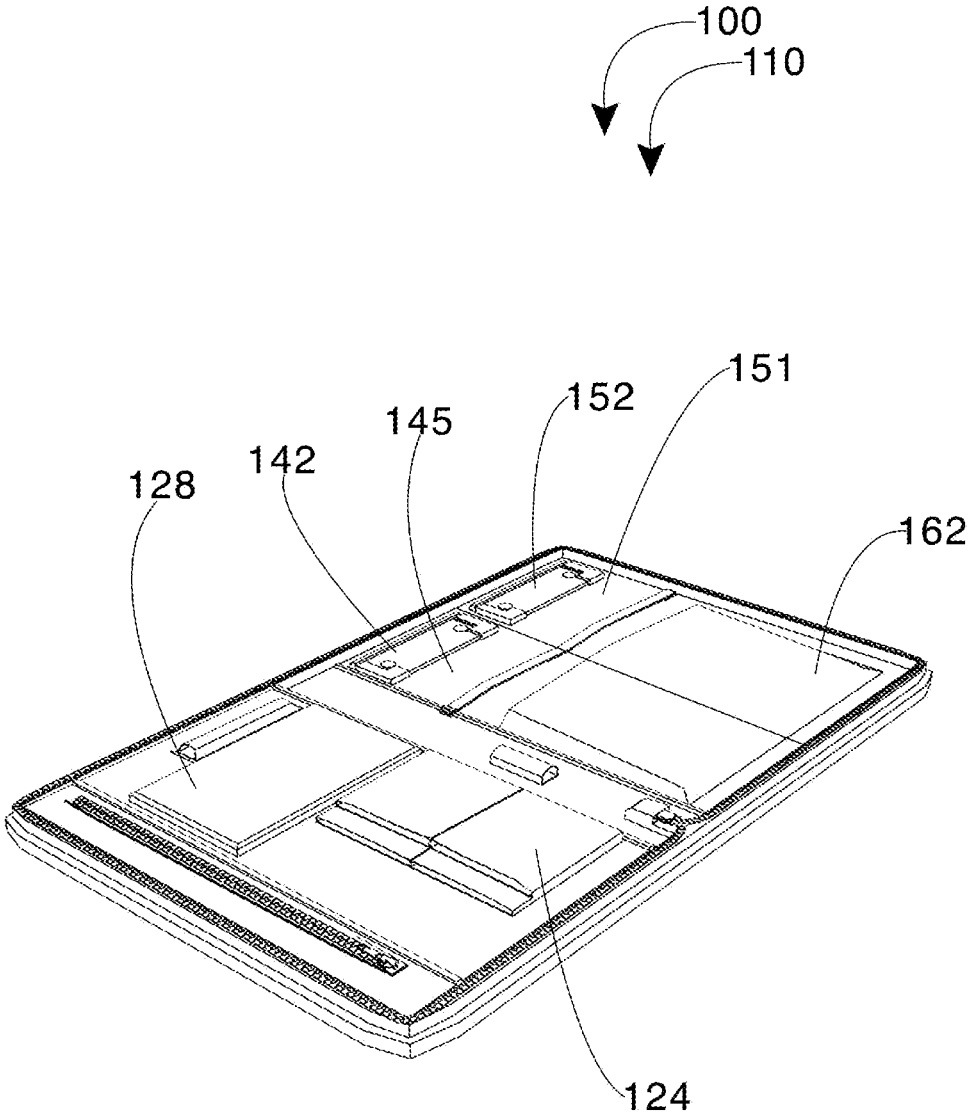
FIG. 3 is a perspective view of the receipt holder device of FIG. 1, according to an embodiment of the present disclosure.

FIG. 3 shows a perspective view of the receipt holder device 100 of FIG. 1, according to an embodiment of the present disclosure. As above, the organizer portfolio 110 is defined by the front-cover 120 and the rear-cover 140. The front-cover 120 and the rear-cover 140 may be sealable by a zipper to enclose contents within the organizer portfolio 110. The interior portion 144 of the rear-cover 140 is separated into a first-half 145 and a second-half 151. The first half 145 includes the first-clip 142 and the first-elastic-fastener 146 and the second-half 151 comprising the second-clip 152 and the second-elastic-fastener 156. The first-clip 142 and the second-clip 152 comprise biasing means for securing receipts 10. The first-elastic-fastener 146 and the second-elastic-fastener 156 are configured to further secure longer receipts 10 in a secure and organized manner. Additional features such as a notepad, calendar, and tax receipt pocket 166 having a magnetic fastener may be included. The tax receipt pocket 166 may include an accordion style set of pockets for storing additional documents and receipts.

Figure 4:
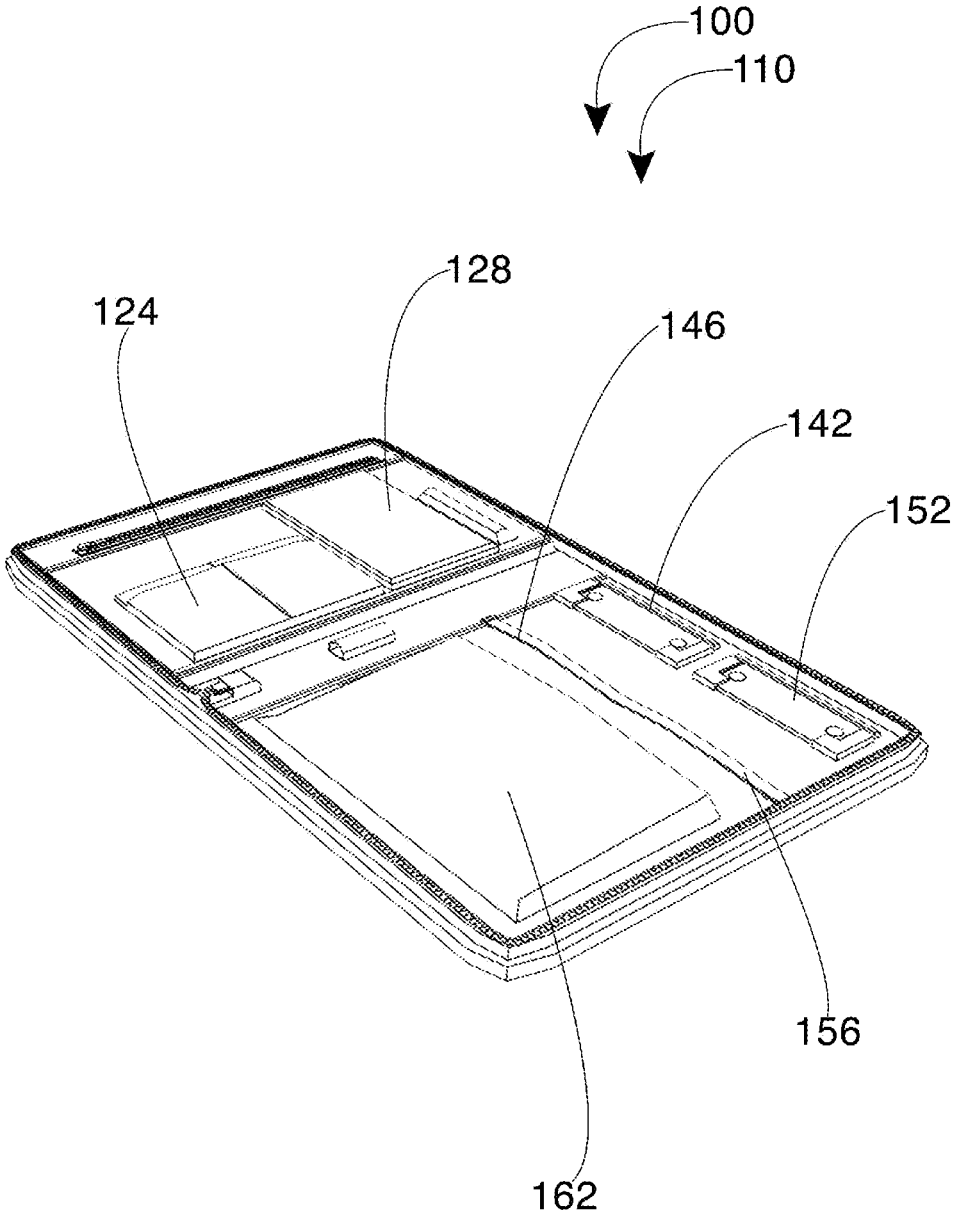
FIG. 4 is a perspective view of the receipt holder device of FIG. 1, according to an embodiment of the present disclosure.

FIG. 4 shows a perspective view of the receipt holder device 100 of FIG. 1, according to an embodiment of the present disclosure. As above, the receipt holder device 100 may include the first-clip 142 and the second-clip 152 used for securing receipts 10 or other documents within the organizer portfolio 110. The first-clip 142 and the second-clip 152 are positioned at a top edge of the interior portion 144 of the rear-cover 140. In a preferred embodiment, the first-clip 142 and the second-clip 152 comprise clipboards clips with rubber feet. Other suitable fasteners may be used. The interior portion 144 of the rear-cover 140 further comprises a retaining pocket 162. The retaining pocket 162 extends along a bottom edge of the interior portion 144 of the rear-cover 140. The retaining pocket 162 is configured to receive a bottom-portion of longer receipts 10 and further secure the receipt 10 in place. A top-portion of the receipt 10 is secured by the first-clip 142 and the second-clip 152 and a middle-portion of the receipt 10 may be secured by the first-elastic-fastener 146 or the second-elastic-fastener 156 depending on which column the receipt 10 is secured on. The retaining pocket 162 is preferably transparent.

Figure 5:
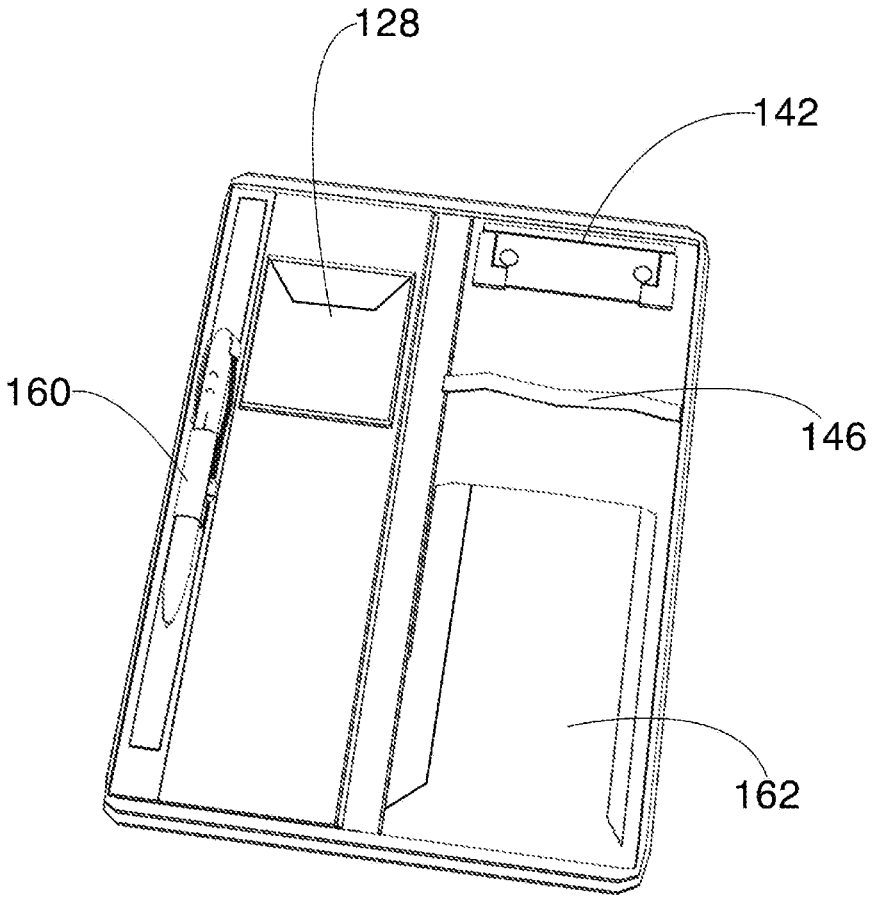
FIG. 5 is a top view of a second embodiment of the receipt holder device of FIG. 1, according to an embodiment of the present disclosure.

FIG. 5 shows a perspective view of the receipt holder device 100 of FIG. 1, according to an embodiment of the present disclosure. As above, the receipt holder device 100 may include other embodiments of the receipt holder device 100. As such, a version may be included having a waterproof half-sized organizer portfolio 110 having only a first-clip 142 and a first-elastic-fastener 146 for personal use and minimal storage capacity.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A receipt holder device comprising:

an organizer portfolio including a front-cover;

at least one card holder;

a storage compartment;

a rear-cover;

a first-clip;

a first-elastic-fastener;

a second-clip;

and a second-elastic-fastener;

wherein said front-cover and said rear-cover of said organizer portfolio are hingedly connected and configured to open and close to access contents within said organizer portfolio;

wherein said at least one card holder and said storage compartment are positioned on an interior portion of said front-cover;

wherein said at least one card holder is configured to receive and hold a card within;

wherein said storage compartment is structured to house at least one office supply item within;

wherein an interior portion of said rear-cover is separated into a first-half and a second-half, said first half including said first-clip and said first-elastic-fastener and said second-half comprising said second-clip and said second-elastic-fastener;

wherein said first-clip and said second-clip comprise biasing means for securing receipts, said first-elastic-fastener and said second-elastic-fastener are configured to further secure said receipts.

2. The receipt holder device of claim 1, further includes a pen holder.

3. The receipt holder device of claim 2, wherein said pen holder is positioned on said interior portion of said rear-cover.

4. The receipt holder device of claim 1, wherein said first-clip and said second-clip are positioned at a top edge of said interior portion of said rear-cover.

5. The receipt holder device of claim 1, wherein said interior portion of said rear-cover further comprises a retaining pocket.

6. The receipt holder device of claim 5, wherein said retaining pocket extends along a bottom edge of said interior portion of said rear-cover.

7. The receipt holder device of claim 6, wherein said retaining pocket is configured to receive a bottom-portion of said receipts and further secure the receipts in place, a top-portion of said receipts being secured by said first-clip and said second-clip and a middle-portion of said receipts being secured by said first-elastic-fastener and said second-elastic-fastener.

8. The receipt holder device of claim 6, wherein said retaining pocket is transparent.

9. The receipt holder device of claim 1, wherein said at least one office supply item includes paper clips.

10. The receipt holder device of claim 1, wherein said storage compartment comprises a sealable flap.

11. The receipt holder device of claim 10, wherein said storage compartment is transparent.

12. The receipt holder device of claim 11, wherein said storage compartment comprises a flexible, sheet of plastic material.

13. The receipt holder device of claim 1, further includes a tax receipt pocket.

14. The receipt holder device of claim 13, wherein said tax receipt pocket comprises a magnetic fastener.

15. The receipt holder device of claim 1, further includes additional fasteners for greater storage capacity.

16. The receipt holder device of claim 1, further includes a notepad.

17. A receipt holder device, the receipt holder device comprising:

an organizer portfolio including;

a front-cover;

a storage compartment;

a rear-cover;

a first-clip;

a first-elastic-fastener;

and a pen holder;

wherein said front-cover and said rear-cover of said organizer portfolio are hingedly connected and configured to open and close to access contents within said organizer portfolio;

wherein said storage compartment are positioned on an interior portion of said front-cover;

wherein an interior portion of said rear-cover includes said first-clip and said first-elastic-fastener;

wherein said first-clip comprises biasing means for securing receipts, said first-elastic-fastener is configured to further secure said receipts;

wherein said pen holder is positioned on said interior portion of said front-cover;

wherein said first-clip is positioned at a top edge of said interior portion of said rear-cover;

wherein said first-clip comprises a clipboard clip; wherein said interior portion of said rear-cover further comprises a retaining pocket;

wherein said retaining pocket extends along a bottom edge of said interior portion of said rear-cover;

wherein said retaining pocket is configured to receive a bottom-portion of said receipts and further secure the receipts in place, a top-portion of said receipts being secured by said first-clip and a middle-portion of said receipts being secured by said first-elastic-fastener;

wherein said retaining pocket is transparent; wherein said storage compartment comprises a sealable flap;

wherein said storage compartment is transparent;

wherein said storage compartment comprises a flexible sheet of plastic material;

and wherein said organizer portfolio is waterproof.

18. A receipt holder device, the receipt holder device comprising:

an organizer portfolio including;

a front-cover;

at least one card holder;

a storage compartment;

a rear-cover;

a first-clip;

a first-elastic-fastener;

a second-clip;

a second-elastic-fastener; and a pen holder;

wherein said front-cover and said rear-cover of said organizer portfolio are hingedly connected and configured to open and close to access contents within said organizer portfolio;

wherein said at least one card holder and said storage compartment are positioned on an interior portion of said front-cover;

wherein said at least one card holder is configured to receive and hold a card within;

wherein said storage compartment is structured to house at least one office supply item within;

wherein an interior portion of said rear-cover is separated into a first-half and a second-half, said first half including said first-clip and said first-elastic-fastener and said second-half comprising said second-clip and said second-elastic-fastener;

wherein said first-clip and said second-clip comprise biasing means for securing receipts, said first-elastic-fastener and said second-elastic-fastener are configured to further secure said;

wherein said pen holder is positioned on said interior portion of said rear-cover;

wherein said first-clip and said second-clip are positioned at a top edge of said interior portion of said rear-cover;

wherein said interior portion of said rear-cover further comprises a retaining pocket;

wherein said retaining pocket extends along a bottom edge of said interior portion of said rear-cover;

wherein said retaining pocket is configured to receive a bottom-portion of said receipts and further secure the receipts in place, a top-portion of said receipts being secured by said first-clip and said second-clip and a middle-portion of said receipts being secured by said first-elastic-fastener and said second-elastic-fastener;

wherein said retaining pocket is transparent;

wherein said storage compartment comprises a sealable flap;

wherein said storage compartment is transparent;

wherein said storage compartment comprises a flexible sheet of plastic material;

and wherein said organizer portfolio is waterproof.

* * * * *